United States Patent [19]

Baumann

[11] 3,948,351

[45] Apr. 6, 1976

[54] CATCHING DEVICE FOR A FREE-FALLING BODY

[75] Inventor: René Baumann, Lucerne, Switzerland

[73] Assignee: Wiba AG, Kriens, Lucerne, Switzerland

[22] Filed: Feb. 28, 1975

[21] Appl. No.: 553,912

[30] Foreign Application Priority Data

Mar. 20, 1974 Switzerland ..... 3870/74
Sept. 24, 1974 Switzerland ..... 12902/74

[52] U.S. Cl. ..... 182/139; 182/140; 272/65
[51] Int. Cl.[2] ..... A62B 1/22; A63B 5/00
[58] Field of Search ..... 182/140, 139, 138, 137; 272/65; 267/170, 167

[56] References Cited

UNITED STATES PATENTS

| | | | |
|---|---|---|---|
| 384,923 | 6/1888 | Moore | 182/139 |
| 480,139 | 8/1892 | Ryan | 182/140 |
| 611,734 | 10/1898 | Hafelfinger | 182/140 |
| 2,430,714 | 11/1947 | Geer | 182/140 |
| 2,724,463 | 11/1955 | Becker | 182/4 |
| 3,675,912 | 7/1972 | Jardins | 267/166 |

*Primary Examiner*—Reinaldo P. Machado
*Attorney, Agent, or Firm*—Werner W. Kleeman

[57] ABSTRACT

A catching device for a free-falling body comprising a material web which is held at opposite sides at support bars or ledges which are supported at a spacing from the floor. The support bars are held resiliently damped at a portable base frame carrying tensioning devices for stretching or tensioning the material web.

29 Claims, 24 Drawing Figures

CATCHING DEVICE FOR A FREE-FALLING BODY

BACKGROUND OF THE INVENTION

The present invention relates to a new and improved construction of catching device for a free-falling body which is of the type comprising a material web held at opposite sides or ends at support bars or ledges which in turn are supported in spaced relationship from the floor.

The catching device of the invention is especially useful for sporting events and can be employed for all types of jumping exercises, such as high jumping and pole vaulting where the device serves for breaking the fall of the athlete following the jump in a gentle manner. Moreover, such catching device can also be used by a fire department in place of the previously employed jumping nets and furthermore can also be used when carrying out difficult exercises or the like.

The heretofore known catching devices employed for the aforementioned purposes were intended to replace the cushion blocks or cushions formed of foamed material or the like which are laid on the ground and most commonly used in high jumping sporting events. Such cushions, owing to their considerable weight and dimensions were not easy to transport and additionally were quite expensive, so that not every sporting club could afford to acquire the same.

The catching devices which were heretofore proposed for the purpose of replacing such cushions possess the drawback that the material web or cloth thereof used for breaking the fall had to be held by posts or columns which must be anchored in floor sleeves or the like, and therefore, the catching device was limited in use at a predetermined place of erection. Owing to the fact that at a sporting field or area different sporting events are carried out at separate locations, it was therefore necessary to provide measures at many different locations of the sporting field to permit anchoring of such prior art catching device at the ground.

SUMMARY OF THE INVENTION

Hence, it is a primary object of the present invention to provide a new and improved construction of catching device for a free-falling body which is not associated with the aforementioned drawbacks and limitations of the prior art proposals.

Another object of the invention aims at the provision of a novel construction of catching device for a free-falling body which is relatively simple in construction and design, economical to manufacture, versatile in use, readily transportable and provides for safe and reliable breaking of the fall of a free-falling body.

Now in order to implement these and still further objects of the invention, which will become more readily apparent as the description proceeds, the catching device of the previously mentioned type as contemplated by the invention is manifested by the features that there are provided two support bars or ledges which are held to be resiliently damped at a transportable or portable base frame which carries tensioning devices for tensioning or stretching the material web or the like.

In order to enable the catching device to be transported as easily as possible from one place to another notwithstanding its considerable dimensions of, for instance, 6 by 3 meters and more, a preferred constructional manifestation of the invention contemplates the possibility of disassembling or folding together the base frame. A construction of foldable base frame for the catching device advantageously embodies two essentially U-shaped supports assembled from individual elements and in the unfolded condition arranged in parallel spaced relationship and which in each instance have inclined upwardly directed legs connecting with a horizontal web portion at an obtuse angle. The supports advantageously extend in the lengthwise direction of the catching device having a long side and a short side and are interconnected by transverse struts as well as by the support bars arranged opposite one another at the leg ends. Furthermore, at least at one side of the base frame there are provided between the leg ends and the support bars effective tensioning devices for tensioning or spanning the material web or the like. These U-shaped supports are advantageously inwardly positioned with regard to the material web surface, i.e. connected with the support bars at a spacing from the ends thereof. For the purpose of folding together the unit each support bar or ledge advantageously consists of three individual elements which are interconnected with one another via two folding joints or hinges possessing horizontal axes or shafts located in the plane of the forces which are to be taken-up by the support bars, and the outer support bar elements including the material web portions held by such bars can be folded inwardly from both sides through an angle of 180° until bearing against the intermediate support bar element.

Also each of both essentially U-shaped supports or carriers of the base frame consists preferably of three individual elements which are essentially of equal length, and the horizontal web portion of a support forming the intermediate element and intended to bear upon the ground is connected, via two folding hinges having vertical axes or shafts located in the plane of the forces which are to be taken-up, with the elements bounding at both ends, so that the base frame can be folded together in an accordion-like manner while outwardly pivoting both of the intermediate elements of both supports. In conjunction with the initial folding action of the support bars when folding together the unit, it is possible to obtain at the end of the folding operation a reduction to about one-sixth of the original area of the catching device. In this size the catching device can be readily transported, for instance with the aid of fixedly arranged rollers or with a separate traveling frame, and such compact catching device possessing the smaller dimensions can be also easily stored.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
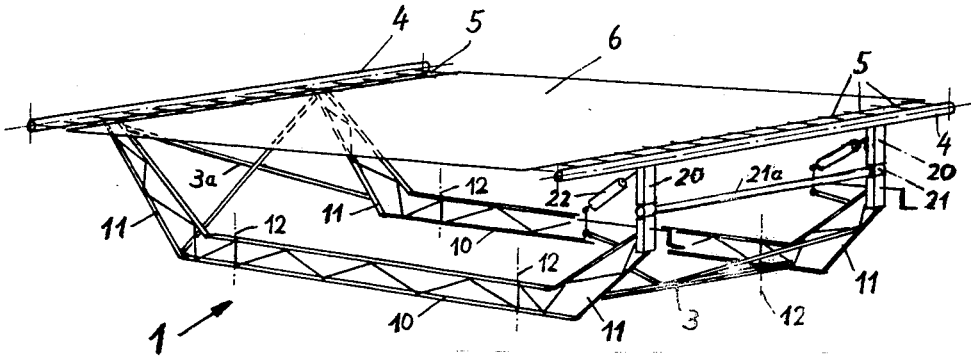
FIG. 1 is perspective view of catch device designed according to the invention.

Describing now the drawings, the transportable or portable catching device shown in FIG. 1 possesses a base frame 1 intended to be erected upon the ground or floor. Base frame 1 is composed of two essentially U-shaped carriers or supports 2 which are connected with one another by fixed transverse struts or braces 3 at one side and foldable transverse struts 3*a* at the other side of the catching device as well as by support bars or ledges 4 arranged at the ends of the U-shaped supports 2. Resilient or spring elements 5 are arranged along both of the support bars or ledges 4, hereinafter referred to simply as the support bars, at a spacing from one another of about 10 centimeters. The spring elements 5 are suspended at opposite edges or sides of a material web or cloth 6 or the like which is thus spanned between the support bars 4.

One of the main facets of the catching or catch device of this development is the collapsibility of the unit and the mechanism for tensioning or stretching the material web, rendering possible a rapid erection and dismantling of the catching device. The forces which are transmitted to the base frame when using the catching device for high jumping or pole vaulting are in the order of several tons, and therefore the supports 2 are constructed as frameworks or trusses. Each substantially U-shaped support 2 consists of a horizontal web portion 10 and the legs 11 which are upwardly directed at an inclination which merge at an obtuse angle with the web portion or crosspiece 10. The ends of the legs or leg members are connected by means of the support bars 4. Each U-shaped carrier consists of three essentially equal length individual elements with folding hinges arranged therebetween and schematically indicated by the vertical axes 12 in FIG. 1. The folding hinges are located somewhat inwardly of the ends of the horizontal web portion 10, resulting from the subdivision of the support into approximately equal length elements. What is important is that the axes or shafts 12 of the folding hinges are located in the plane of the direction of application of the primary force for the supports, so that there is no reduction in the rigidity of the construction which, for instance, would be the case with horizontal folding axes at the supports, requiring a complicated construction in order to insure for the rigidity of the structure and to safeguard against undesired collapsing or inward folding thereof.

Figure 3:
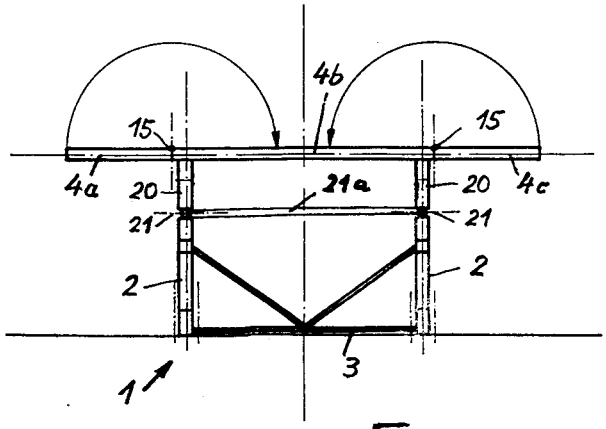
FIG. 3 is a side view of the narrow or shorter side of such catching device.

From the showing of FIG. 3 it will be recognized that also the support bars 4 consist of three individual elements 4*a*, 4*b* and 4*c* which are interconnected with one another by the folding hinges or joints. Also in this case the folding axes 15 are located in the plane of the forces to be taken-up by the support bars and therefore extend horizontally, so that the support bar under load cannot bend-out at its hinges. As best seen by referring to FIGS. 1 and 3 the supports 2 of the base frame are connected with the support bars in spaced relation from the outer ends of the support bars, and the folding hinges with the folding axes or shafts 15 are located externally of the connection locations between the supports and the horizontal support bars.

From the showing of FIG. 3 it will be further apparent that both of the outer elements 4*a* and 4*c* of the support bars can be inwardly folded through an angle of 180° until bearing against the intermediate or central part or element 4*b* of the support bar.

Figure 4:
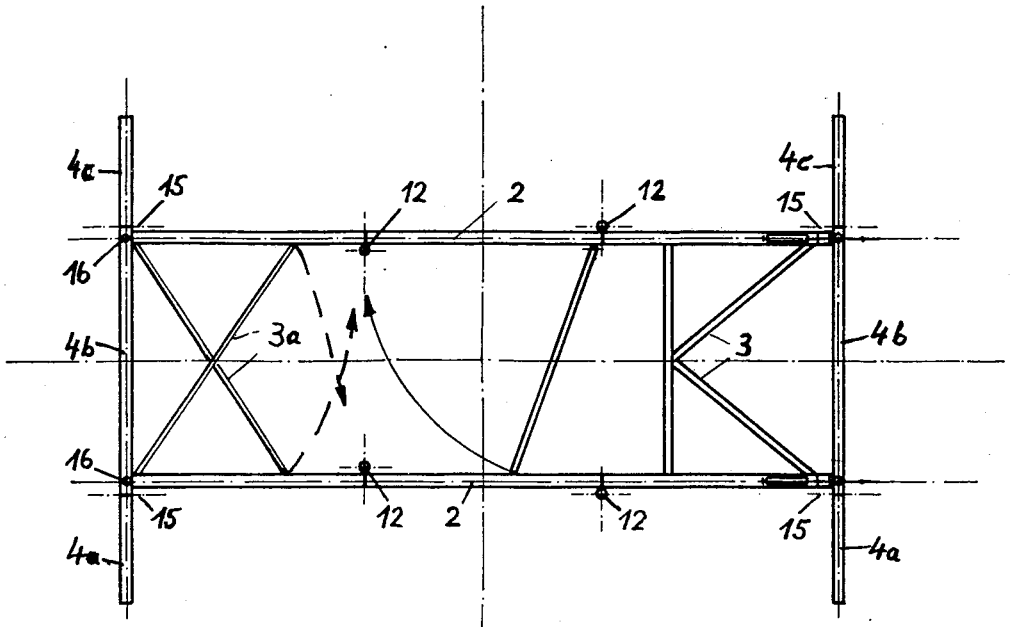
FIG. 4 is a plan view from the top of the base frame but without the material web or cloth.
Figure 5:
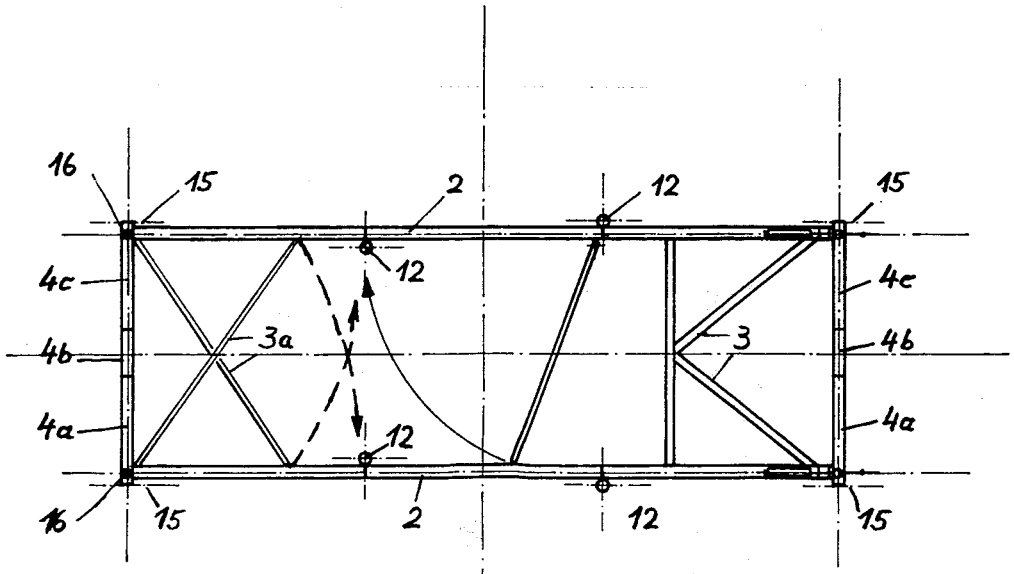
FIG. 5 is a plan view according to the showing of FIG. 4 after there has been carried out the folding of the support bars or ledges.
Figure 6:
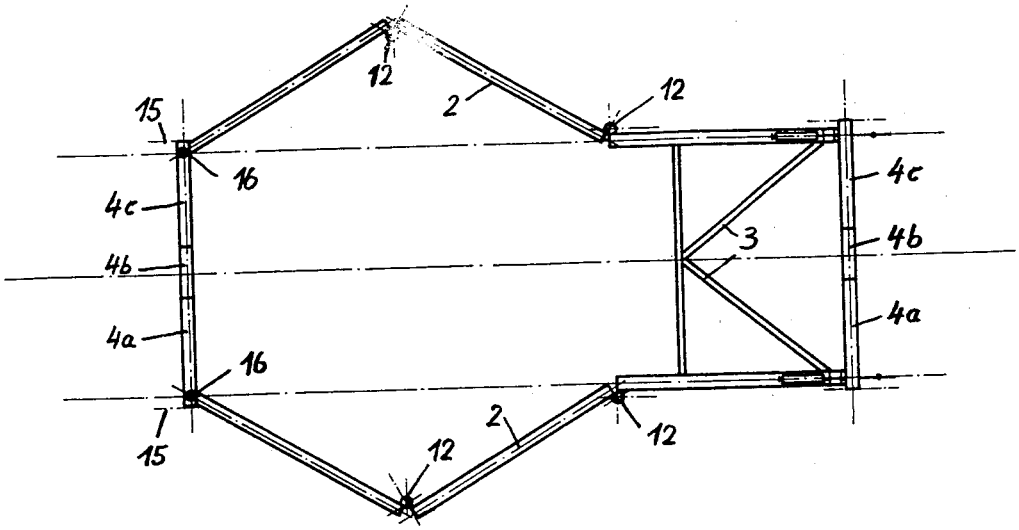
FIG. 6 is a plan view of the base frame in an intermediate stage during folding together of the lengthwise or longitudinal supports.
Figure 7:
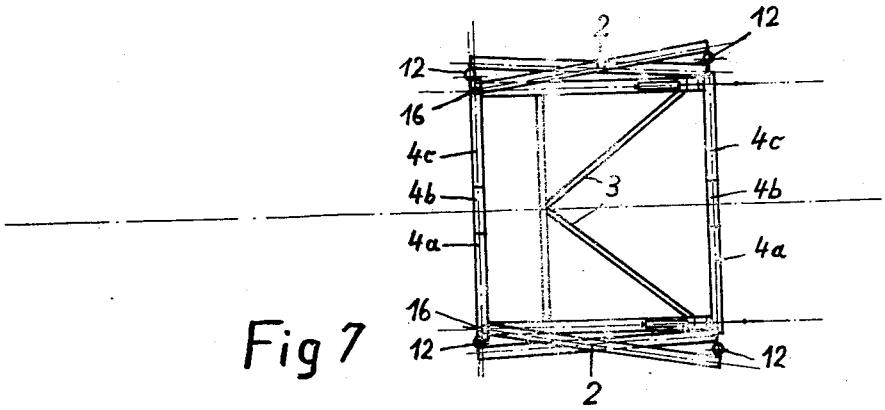
FIG. 7 is a plan view of the completely folded together base frame.

In FIG. 4 there is illustrated a top plan view of the base frame erected for use without, however, showing the material web or the like which is spanned between the support bars 4. The plan view of FIG. 5 shows the first phase during collapsing or folding together of the base frame when initially, according to the illustration of FIG. 3, the outer support bar elements are folded towards the inside. The support bar 4 shown in FIGS. 4 and 5 at the left-hand side of the illustration is connected with both of the U-shaped supports 2 by means of pivot pins 16. This renders possible folding together of the base frame following the inward folding of the support bars, according to the showing of FIG. 6 by displacing the support bar arranged at the left end parallel to itself and in a direction towards the oppositely situated support bar and while outwardly pivoting the intermediate element and the left-hand portrayed individual element of both supports 2, the intermediate individual elements describing a circular arc extending through 180°. Consequently, the individual components can ultimately assume a position as shown in FIG. 7 in which the catching device now only occupies about one-sixth of the original space. When using the catching device for high jumping the material web between the support bars should advantageously possess a dimension of about 6 by 3 meters and for pole vaulting should be of even greater size, so that due to the collapsing of the unit there can be obtained a reduction in size to about 3 square meters area and without impairing the static properties of the device.

Figure 8:
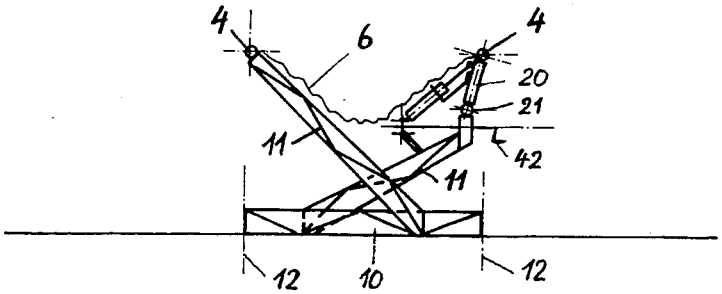
FIG. 8 is a side view of the base frame in the folded condition of FIG. 7.

In FIG. 8 there is illustrated the folded together catching device as viewed from the side, and it will be recognized that the material web which is folded-over a number of times hangs-through towards the inside.

A collapsible or foldable catching device must also possess a tensioning or spanning device, since the tension exerted at the material web or cloth should amount to about 600 kg, and in order to achieve such value also requires a force increase in the form of a stepping up. There is necessary a pre-stressing of the material web which is always exactly maintained in order that the deceleration of the free-falling body always begins at the same point of the spring characteristic. If, for instance, during high jumping the center of gravity of the athlete is located at the zenith of his trajectory 2.4 meters above the ground and the athlete has a body weight of 75 kg and the spring force of the springs arranged along the material web amounts to 600 kg there is obtained for certain quality requirements which are placed upon the material web and a penetration depth into such of about 0.5 meters a deceleration of the body of 3 g (on the average) with a pre-tensioning or pre-stressing of the material web in the order of 600 kg, so that there occurs in the latter a one-third greater dynamic force.

Figure 2:
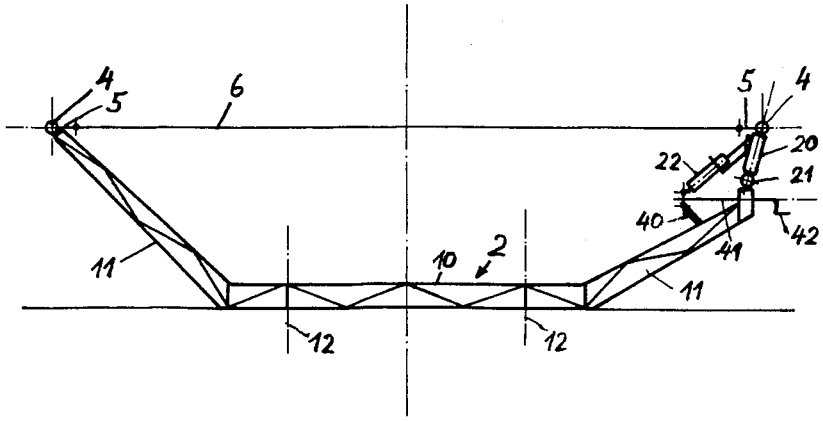
FIG. 2 is a side view of the long side of the catch or catching device portrayed in FIG. 1.

As also can be readily recognized from the showing of FIGS. 1 and 2 the base frame possesses at the right-hand side of the drawing at the ends of both supports 2 a respective bracing or support element 20 movable in a plane which is perpendicular to the support bars, the support or bracing elements 20 being hingedly connected at locations 21 with the U-shaped carriers, and both hinges are interconnected with one another by a torsion bar or rod 21*a*. At the upper ends of these pivotably movable support elements 20 there is attached the associated support bar 4, and beneath such upper ends there engages a respective tensioning or spanning device at the support elements.

Figure 9:
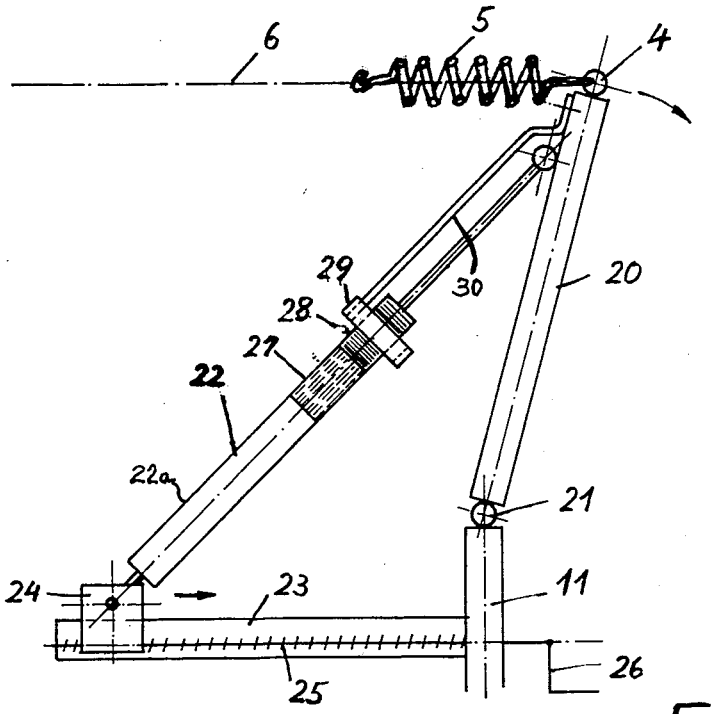
FIG. 9 illustrates in side view on an enlarged scale a detail of the catching device with the tensioning device.

Continuing, each tensioning device, such as the one illustrated on an enlarged scale in FIG. 9 comprises a damping element hingedly connected with its upper end at the support or bracing element 20, such damping element being in the form of a shock absorber 22 combined with a spring, for instance a gas spring or steel spring. The lower end of the shock absorber 22 is movably supported at an inwardly directed cantilever or overhang arm 23 of the base frame, and furthermore such shock absorber, between its support points, is upwardly directed at an inclination with respect to the outside of the catching device. At the lower end of the shock absorber 22 there is located a sliding element 24 which can be moved towards the right upon the cantilever 23 in the direction of the arrow by means of a threaded spindle 25 which can be rotated by a crank 26, so that the springs 5 provided between the material web 6 and the support bar 4 are pre-stressed or biased. In so doing also the relatively movable components, namely the cylinder and piston rod of the shock absorber are moved within one another. This movement simultaneously renders discernible in a simple indicator device the operational readiness of the catching device when there has been obtained a sufficient pre-bias. For this purpose the shock absorber cylinder 22*a* is marked with different colors 27 and 28, and an indicator ring 29 which slides over the cylinder 22*a* and which is connected at the top by means of a rod 30 at the support or bracing element 20, moves for instance from a red color ring 28 into the region of the adjoining color ring 27 for instance which is green, and in which position there is first attained the satisfactory pre-biasing.

In FIGS. 10 to 18 inclusive there are illustrated different possibilities for the construction of the tensioning device. With the variant embodiment of FIG. 10 which is illustrated the same as in FIG. 9, the threaded spindle 25 can be driven by means of the hand crank 26, whereas in the embodiment of FIG. 11 it can be driven by means of an electric motor 30. According to the embodiment of FIG. 12 the sliding element or block 24 guided at a rigid cantilever 23 is moved by means of a pneumatic- or hydraulic cylinder unit 31 and with the embodment of FIG. 13 by means of a gear rack 32 and ratchet 33. Instead of the sliding element 24 being guided along the cantilever 23 it can also be directly guided at the inclined portion 11 of the base frame 1.

Figure 14:
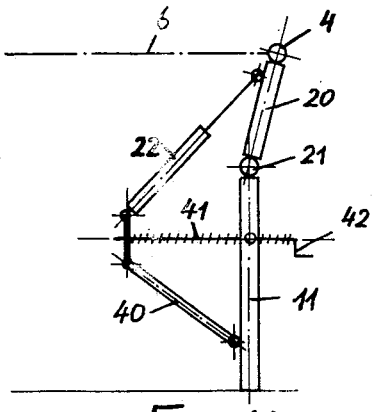
Figure 11:
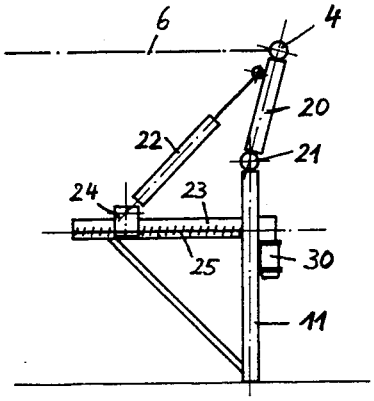
Figure 15:
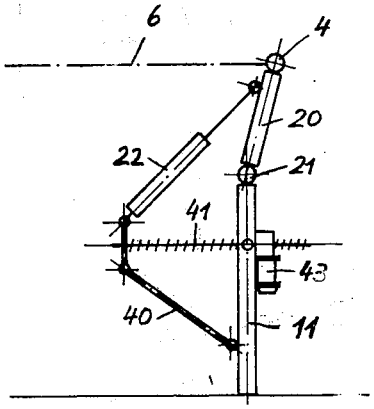
Figure 12:
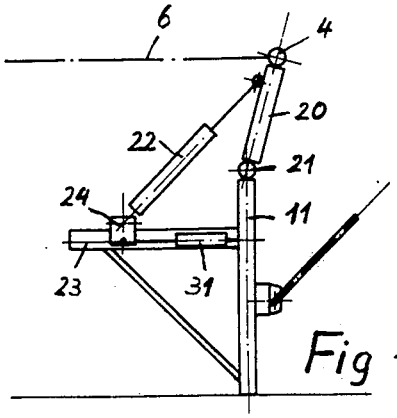
Figure 16:
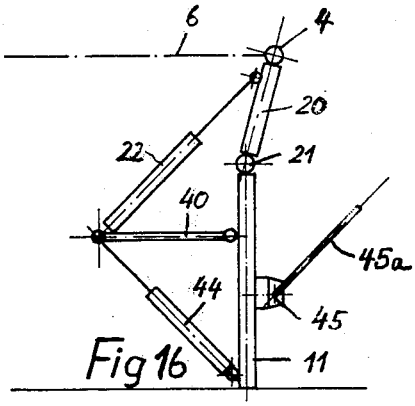
Figure 13:
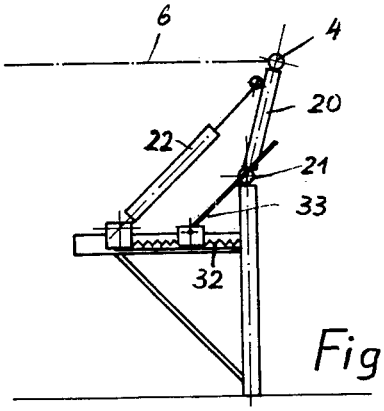
Figure 17:
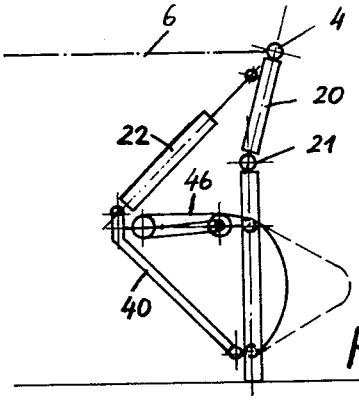
Figure 18:
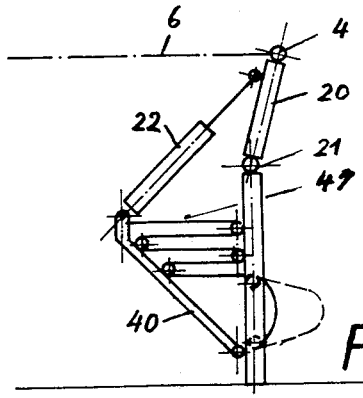

According to the showing of FIGS. 14 to 18 the tensioning or stretching device does not possess a rigid cantilever, rather a movable cantilever or overhang arm 40 which is hinged at the base frame and a threaded spindle 41 which is pivotably mounted at the base frame. In the arrangement of FIG. 14 the threaded spindle 41 can be operated by means of the hand crank 42 and with the embodiment of FIG. 15 by means of a suitable electric motor 43. According to the embodiment of FIG. 16 a pneumatic- or hydraulic cylinder unit or arrangement 44 cooperates with the end of the cantilever 40, the cylinder receiving the pressurized medium from a pump 45 with associated manually-operated lever 45*a*. According to the embodiment of FIG. 17 a tension cable 46, working as a block and tackle device, cooperates with the end of the movable cantilever 40, or according to the embodiment of FIG. 18 a simple tension belt cooperates with the end of the movable cantilever 40.

Figure 19:
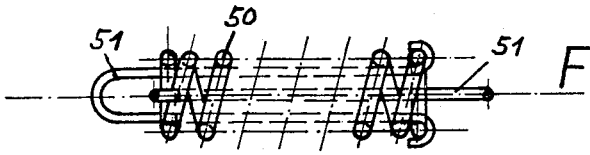
FIGS. 19 to 21 illustrate different embodiments of springs arranged between the material web and support bars or ledges.
Figure 20:
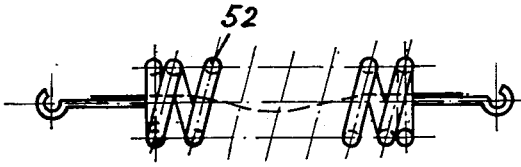
Figure 21:
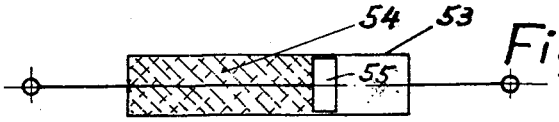
Figure 10:
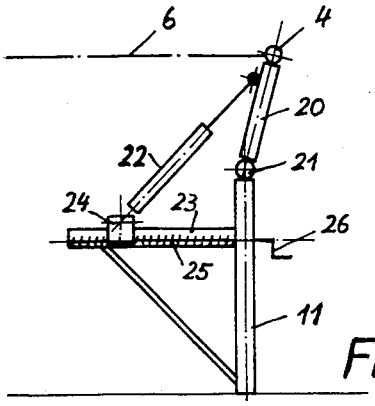
FIGS. 10 to 18 illustrate different exemplary embodiments for the actuation of the tensioning device by manual operation, electric motor, hydraulic- or pneumatic cylinder, gear rack, cable means or belt means.

As already mentioned heretofore between the support bars 4 and the material web 6 or the like there are provided the spring or resilient elements 5 illustrated in FIGS. 1, 2 and 9 and arranged at a spacing from one another of about 10 centimeters. According to the showing of FIG. 19 such spring elements can be pressure or compression springs 50 which are loaded under tension by means of a bracket 51 engaging behind one spring end and extending through the spring and passing the other spring end. According to the showing of FIG. 20 the spring elements can also be constituted by tension springs 52 which are internally provided with a cable which is loose in the tensionless state and first after reaching a certain tension force non-resiliently transmitting the same, or else according to the showing of FIG. 21 such can be tension dampers wherein foamed material 54 contained in a cylinder 53 is compressed by a piston 55.

With a construction of a further exemplary embodiment of the catching device there is aimed at attaining the tensioning and relaxation of the material web with simpler means than those previously described, since threaded spindles and sliding elements or blocks or corresponding constructional elements are relatively expensive. In this regard there was started with the consideration that the relaxation or untensioning of the material web which is necessary for the disassembly of a device with rigid base frame or for the collapsing of the base frame could be also attained in a different way in that the spring force producing the tensioning of the material web in the operating position of the catching device is opposed with a larger force, that is to say, the former force is more or less eliminated, leading to certain advantages.

Figure 22:
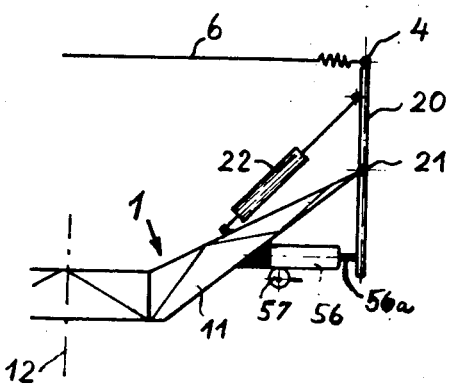
FIGS. 22 to 24 illustrate respective side views of the right-hand portion of a further exemplary embodiment of catching device equipped with a lifting cylinder for relieving or untensioning the material web and showing such embodiment in three different positions.
Figure 23:
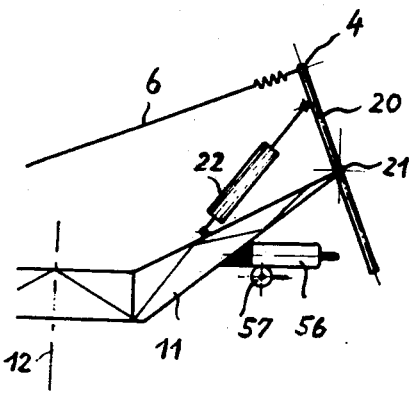
Figure 24:
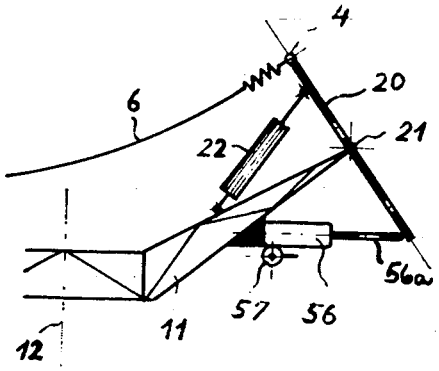

This further embodiment of catching or catch device, wherein only the right-hand portion thereof has been illustrated in FIGS. 22 to 24, possesses a base frame designated with the same reference characters as employed for the corresponding components of the previously described catching device, this base frame 1 essentially consisting of two parallely arranged carriers or supports which are interconnected with one another by the transverse struts as previously explained, and of such two supports which are arranged behind one another only one has been shown in the schematic illustration according to FIGS. 22 to 24. At the inclined upwardly directed leg or portion 11 of each support, constructed as a trussing, of the base frame 1 there is hinged at the end thereof a support bar- supporting element 20 by means of a pivot or hinge joint 21. The upper ends of both support elements 20 at each support of the base frame are interconnected by a support bar or ledge 4 at which there is secured the one edge or side of the material web 6 or the like for catching the free-falling body. The support bar- supporting elements 20 are inwardly and outwardly pivotable with respect to the base frame in a plane perpendicular to such support bar 4. Between the support frame and each support or supporting element 20 there is arranged in each case at an inclination a damping element in the form of a spring-shock absorber 22, the lower end of which is articulated at the support of the base frame and the upper end of which at the support element 20 below the support bar. In the operationally ready position as shown in FIG. 22 the material web 6 is stretched or tensioned owing to the pre-stress of the spring-shock absorber 22, and thus, the support element 20 is pressed outwardly.

Of the two support bar-support elements 20 at one side of the base frame at least one is downwardly extended past the pivot joint or hinge 21, and the lower end is located at a short distance from the piston rod 56*a* of a lifting cylinder 56 which is substantially horizontally arranged at the base frame. As the lifting cylinder or cylinder assembly 56 there can be used a simple hydraulic lifting jack. As best seen by referring to FIG. 22, the support bar-support element 20, upon impact of a free-falling body at the material web 6, can freely rock about the pivot or hinge joint 21, and the part located beneath the hinge joint 21 can move away from the lifting cylinder assembly 56.

In order that the base frame 1 can be folded together or collapsed, and as previously described, to which end the supports of the base frame are pivotable about vertical axes or shafts 12, it is necessary to first relieve or relax the material web 6. For this purpose there is activated the hydraulic lifting jack constituted by the lifting cylinder assembly 56, so that its extended piston rod 56*a* outwardly presses the part of the support or supporting element 20 located beneath the pivot or hinge joint 21. Consequently, the part of the support element 20 which extends upwardly from the hinge joint 21 is rocked inwardly against the action of the there articulated spring-shock absorber 22 and the material web 6 or the like is relaxed or relieved of its tension. The base frame 1 can then be folded together, and since in this condition the spacing of both support bars 4 serving for the attachment of the material web 6 is considerably reduced —and of which support bars only the one at the right is shown in FIGS. 22 to 24— and the material web thus hangs loosely, it is possible to again retract the piston rod 56*a* of the lifting cylinder 56 in order to unload the spring-shock absorber 22, and which can occur by actuating a manually operated screw 57. Upon erection of the catching device the previously described operations or steps are to be carried out in the corresponding reverse sequence wherein initially the piston rod 56*a* of the lifting cylinder 56 is extended in order to be able to unfold the base frame, and subsequently the piston rod 56*a* of the lifting cylinder 56 is retracted, so that the spring-shock absorber spans the material web.

If there is only provided one lifting cylinder then the pivoting movement must be transmitted to the second support bar-support element 20 articulated at the base frame. For this purpose the pivots or hinge joints 21 which are located in front of one another in the plane of the drawing are connected by a tubular member or pipe which has not been shown in the drawing and which transmits the torsional force.

The mechanism for removing the pre-tensioning or bias of the material web, instead of being equipped with the lifting cylinder operating with pressure force, could also equally be equipped with means which through the application of a tension force exerted between the base frame and the part of the support or supporting element 20 extending above the hinge joint inwardly rocks such support element or supporting element 20.

The advantage of the last described apparatus not only resides in the fact that it is very simple and economical, but in contrast to the proposals described in conjunction with FIGS. 1 to 21, in this case the forces which are considerable and occurring during operation are not transmitted via the tensioning device, and furthermore, the tensioning is independent of the adjustment of the operator, something which is not the case for the previously described tension device equipped with threaded spindles, etc., which are to be actuated manually.

Equally it would be also possible to hold the support element which is inwardly rocked by loading the material web with the weight of a larger number of persons in such rocked or pivoted position by means of locking hooks which connect the support elements with the base frame.

In summation it can be stated that with the described embodiments of catching devices there is provided an auxiliary device for sporting purposes and which is not bound to any specific erection site, is easily transportable and can be erected so as to be operationally ready with only a few manual manipulations, and when folded together requires relatively very little space and above all is considerably cheaper than the previously discussed cushions heretofore predominantly employed for the aforementioned purpose.

While there is shown and described present preferred embodiments of the invention, it is to be distinctly understood that the invention is not limited thereto, but may be otherwise variously embodied and practiced within the scope of the following claims. Accordingly,

What is claimed is:

1. A catching device for a free-falling body, comprising a transportable base frame, a material web having two oppositely situated sides, a pair of oppositely situated support bars for holding the material web at said two oppositely situated sides, means for resiliently dampingly supporting the support bars at the transportable base frame in spaced relationship from the ground, tensioning means carried by said transportable base frame for tensioning the material web, said transportable base frame being constructed to be foldable, the foldable base frame comprising two essentially U-shaped supports which in the unfolded condition of the base frame are arranged in spaced substantially parallel relationship to one another, each U-shaped support having upwardly inclined directed legs merging with a substantially horizontal web portion of the associated U-shaped support, said two U-shaped supports being interconnected by transverse struts and by said oppositely situated support bars which are arranged at the ends of said legs, and said tensioning means being provided at least at one side of the base frame between the ends of the U-shaped supports and the neighboring support bar.

2. The catching device as defined in claim 1, further including means for connecting said U-shaped supports of the base frame in spaced relationship from the ends of the support bars and with said support bars, wherein each support bar comprises three individual elements defined by an intermediate element and two outer elements which are interconnected with one another through the agency of two folding hinges, said folding hinges being located externally of the connection locations of the support bars with said U-shaped supports, said folding hinges having axes located in the plane of the forces which are to be taken-up by the support bars, the outer elements of each support bar together with the material web held thereby being inwardly folded from both sides through an angle of approximately 180° until bearing against the intermediate element of the associated support bar.

3. The catching device as defined in claim 2, wherein each U-shaped support of the base frame comprises three essentially equal length individual elements incorporating said horizontal web portion and to each side thereof one of said legs, said horizontal web portion of each U-shaped support which is intended to bear against the ground being connected with the elements incorporating said legs and bounding at both ends of said horizontal web portion by means of two folding hinge means having substantially vertical axes located in the plane of the forces which are to be taken-up, said base frame being foldable by displacing one support bar, secured at one end of said base frame via hinges with substantially vertical axes, parallel to itself and towards the other support bar and while outwardly pivoting both of the intermediate elements defined by said web portions of both U-shaped supports through an angle of about 180°, said folding together of the catching device occurring in an accordion-like fashion.

4. The catching device as defined in claim 3, wherein each of the substantially U-shaped supports of the base frame are constructed as trussing.

5. The catching device as defined in claim 4, wherein said means for connecting said U-shaped supports with the support bars comprises support bar-supporting elements arranged at least at one side of the base frame at the connection location with the associated support bar, said supporting elements being movable in a plane which is substantially perpendicular to said associated support bar, said tensioning means engaging at said supporting elements in order to tension the material web by increasing the mutual spacing between the support bars.

6. The catching device as defined in claim 5, wherein each of the tensioning means for moving the associated support bar retaining the material web relative to the base frame comprises a respective damping element having an upper end and a lower end, the upper end of the damping element being hingedly connected with the associated movable supporting element and the lower end of each said damping element being connected at an inwardly directed cantilever of the base frame, said damping element being movably supported and disposed at an inclination, and means for moving the supported lower end of each damping element towards the outside towards an end of the base frame for the purpose of obtaining a pivotal movement of the support bar about a respective hinge provided between the base frame and the associated supporting element, and wherein said hinges are interconnected by a tubular member for transmitting torsional forces.

7. The catching device as defined in claim 6, wherein each damping element comprises a shock absorber.

8. The catching device as defined in claim 6, wherein said means for moving the supported lower end of each damping element comprises a respective sliding element guided at the associated cantilever, said cantilever being rigidly mounted at said base frame, and means cooperating with each of said sliding elements for displacing the same.

9. The catching device as defined in claim 8, wherein each of said cooperating displacing means comprises a hand crank.

10. The catching device as defined in claim 8, wherein each of said cooperating displacing means comprises an electric motor and a threaded spindle, said threaded spindle being driven by said electric motor for displacing the associated sliding element.

11. The catching device as defined in claim 8, wherein each of said cooperating displacing means comprises fluid-operated cylinder means for moving the associated sliding element.

12. The catching device as defined in claim 11, wherein said fluid-operated cylinder means comprises a pneumatic cylinder arrangement.

13. The catching device as defined in claim 11, wherein said fluid-operated cylinder means comprises a hydraulic cylinder arrangement.

14. The catching device as defined in claim 8, wherein each of said cooperating displacing means comprises a gear rack and a ratchet, said ratchet actuating said gear rack for moving the associated sliding element.

15. The catching device as defined in claim 6, wherein said means for moving the supported lower end of each damping element comprises a cantilever hingedly movably connected at the base frame, said cantilever having a cantilever free end, and means cooperating with said free end of the cantilever for moving said free end towards the outside.

16. The catching device as defined in claim 15, wherein said cooperating moving means comprises a hand crank.

17. The catching device as defined in claim 15, wherein said cooperating moving means comprises a threaded spindle, means pivotably mounting said threaded spindle at said base frame, and an electric motor for actuating said pivotably mounted threaded spindle.

18. The catching device as defined in claim 15, wherein said cooperating moving means comprises a fluid-operated cylinder means.

19. The catching device as defined in claim 18, wherein said fluid-operated cylinder means comprises a pneumatic cylinder arrangement.

20. The catching device as defined in claim 18, wherein said fluid-operated cylinder means comprises a hydraulic cylinder arrangement.

21. The catching device as defined in claim 15, wherein said cooperating moving means comprises cable means.

22. The catching device as defined in claim 15, wherein said cooperating moving means comprises belt means.

23. The catching device as defined in claim 6, wherein each of the tensioning means incorporates an indicator device for visually indicating the attained tensioning of the material web, said indicator device comprising markings applied at components of the shock absorber which are movable relative to one another during the tensioning operation.

24. The catching device as defined in claim 23, wherein said markings being in the form of a movable indicator ring having different colored regions.

25. A catching device for a free-falling body, comprising a transportable base frame, a material web having two oppositely situated sides, a pair of oppositely situated support bars for holding the material web at said two oppositely situated sides, means for resiliently dampingly supporting the support bars at the transportable base frame in spaced relationship from the ground, tensioning means carried by said transportable base frame for tensioning the material web, and wherein support bar-supporting elements are hinged at least at one side of the base frame by means of a respective hinge means, the support bar together with the material web at said one side being secured at upper ends of said supporting elements, said supporting elements being pivotably movable in a plane which is substantially perpendicular to the associated support bar, and an inclined arranged spring-shock absorber having fixed hinge points located between each support bar-supporting element and the base frame, the shock absorber in the operating position of the catching device retaining the material web in a tensioned state, and means provided at the base frame which are actuatable in a manner to inwardly pivot the associated support bar-supporting element by means of a force acting opposite to the spring-shock absorber for the purpose of relaxing the material web.

26. The catching device as defined in claim 25, wherein at least one supporting bar-supporting element is extended downwardly past its hinge means, and the means for pivoting the supporting element comprises a lifting cylinder arranged at the base frame beneath the hinge means, said lifting cylinder having a piston rod which can be brought into entraining engaging relationship with the lower end of the extended supporting element.

27. The catching device as defined in claim 26, wherein a number of support bar-supporting elements are connected with one another at the same side of the base frame for attaining the same pivoting movement.

28. The catching device as defined in claim 27, wherein the number of support bar-supporting elements are connected with one another by means of a tubular element transmitting the torsional force and coupling the hinge means.

29. The catching device as defined in claim 26, wherein the lifting cylinder comprises a hydraulic lifting jack.

* * * * *